United States Patent [19]

Kaneko

[11] 4,112,669

[45] Sep. 12, 1978

[54] DIGITAL ELECTRONIC TIMEPIECE

[75] Inventor: Noboru Kaneko, Tokyo, Japan

[73] Assignee: Kabushiki Kaisha Daini Seikosha, Japan

[21] Appl. No.: 732,028

[22] Filed: Oct. 13, 1976

[30] Foreign Application Priority Data

Oct. 13, 1975 [JP] Japan ..... 50/123009

[51] Int. Cl.[2] ..... G04B 19/24

[52] U.S. Cl. ..... 58/4 A; 58/85.5; 58/23 R; 58/58

[58] Field of Search ..... 58/57, 58, 85.5, 4 A, 58/23 R

[56] References Cited

U.S. PATENT DOCUMENTS

| | | | |
|---|---|---|---|
| 3,866,406 | 2/1975 | Roberts | 58/58 |
| 3,935,700 | 2/1976 | Van Haaften | 58/58 |

*Primary Examiner*—Gene Z. Rubinson
*Assistant Examiner*—Leonard W. Pojums, Jr.
*Attorney, Agent, or Firm*—Robert E. Burns; Emmanuel J. Lobato; Bruce L. Adams

[57] ABSTRACT

An electronic timepiece including a second counter, a minute counter, an hour counter and a date counter connected in cascade. Each of the counters develops a respective count representative of seconds, minutes, hours and date. A display is responsive to the counts developed by the respective counters for displaying time. A date-seconds selecting circuit, responsive to a control signal, selectively applies a respective one of the counts developed by the second counter and the date counter under control of the control signal for selectively displaying seconds and date. Control circuitry is operable for developing the control signal to select seconds and date display.

1 Claim, 4 Drawing Figures

FIG.3
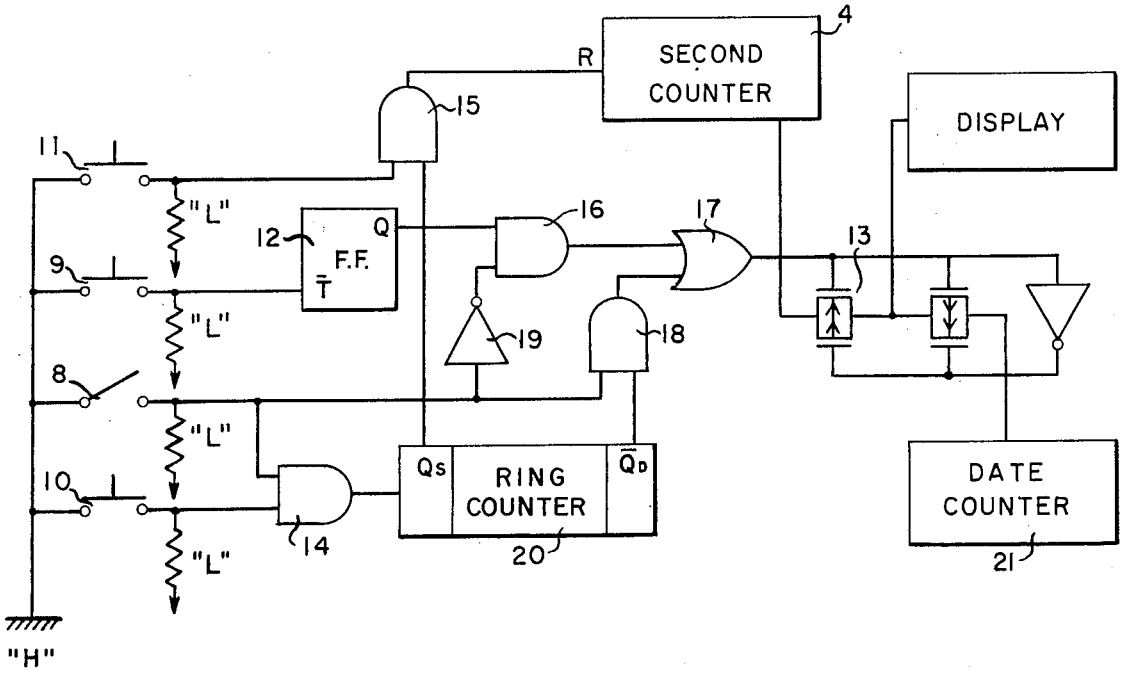
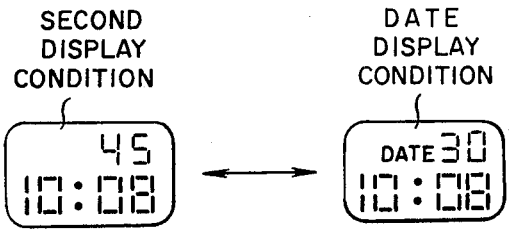
FIG.4

DIGITAL ELECTRONIC TIMEPIECE

DETAILED DESCRIPTION OF THE INVENTION

This invention relates to a digital electronic watch, particularly to a switching means for selectively displaying and amending a second display and a date display.

In the conventional, the second and date displays were respectively separately displayed, whereby a display dimension become larger and the segment number become larger.

The present invention aims to eliminate the above noted difficulty and insufficiency, the object of the present invention is to provide a means for resetting a second zero only when the second display is displayed to the display device without a carry, the other object of the present invention is to provide a display device for selectively displaying the second and date displays by the one display device.

EXPLANATION OF THE DRAWINGS

FIG. 2 shows the wave forms for explaining the operation of the date/second selecting display condition. 1 . . . NOR-gate 2 . . . NOR-gate 3 . . . AND-gate 4–7 . . time counter 8 . . . safety lock 9 . . . date/second selecting switch circuit 10 . . . amendment call switch 11 . . . second reset switch Referring now to the embodiment of the present invention accompanying drawings in which:

FIG. 1 shows one embodiment of the present invention, the electronic timepiece is composed of the time counters 4–7, an oscillating circuit 14, the switching circuits 8–11 for the time amendment, a circuit T-FF 12 for an amendment call means of being connected to the date/second selecting switch, NOR-gates 1 and 2, AND-gate 3 and a date/second display selecting circuit 13.

Figure 1:
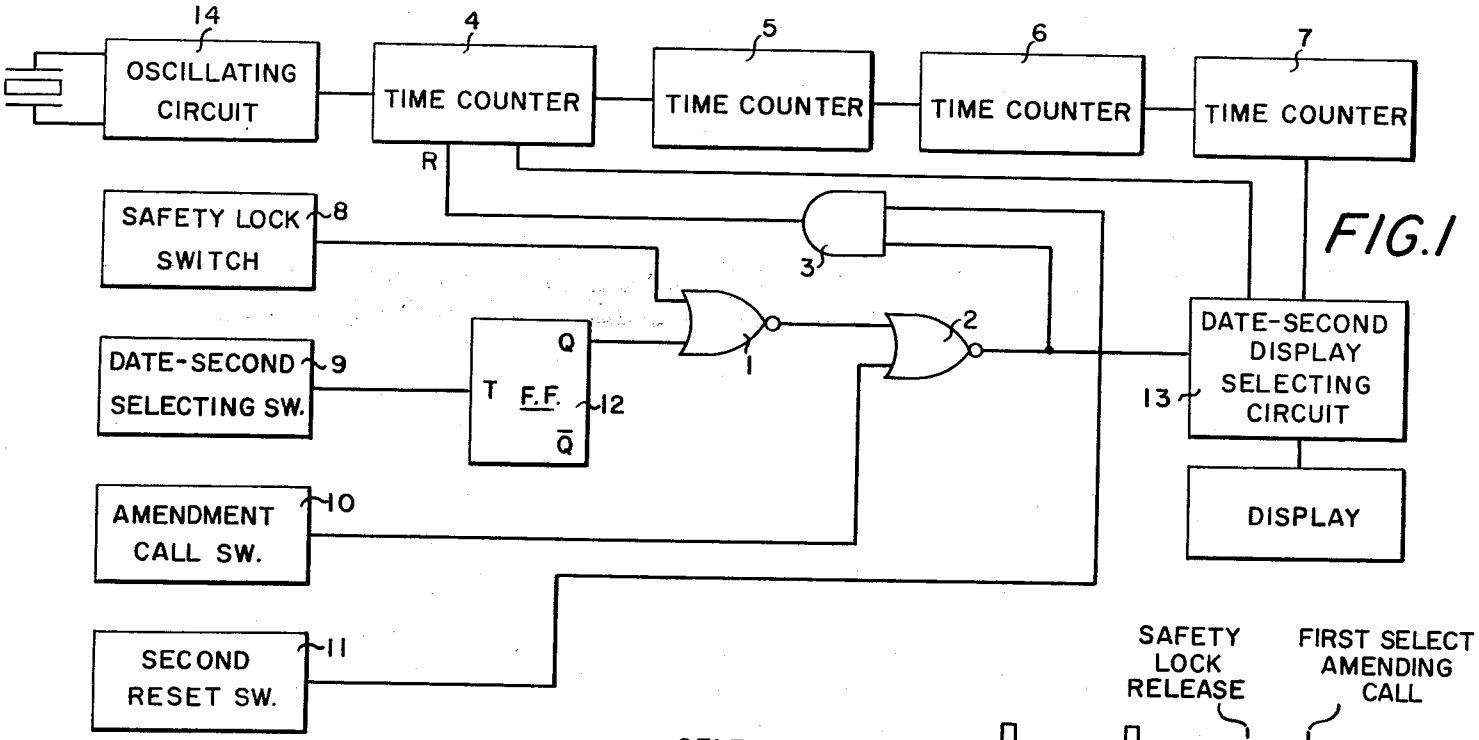
FIG. 1 shows one embodiment of the present invention.

The switching circuits 8–11 are as folows: The safety lock switch 8 is employed for avoiding a mis-operation, said safety lock switch 8 have to be released for amending the time. Said date/second selecting switch 9 is able to select the date display and second display in the time display device, said amendment call switch 10 is operated only when said safety lock switch was released. The second reset switch is able to change the second display to zero. The output of said date/second selecting switch 9 is connected to T-type flip flop 12, the outputs of said T-type flip flop 12 and said safety lock switch 8 are connected to NOR-gate 1, the outputs of said NOR-gate 1 and said amendment call switch 10 are applied to NOR-gate 2. The output of NOR-gate 2 is applied to the input terminal of said date/second display selecting circuit 13 of being connected to said second and date counters 4 and 7. The outputs of said second reset switch 11 and NOR-gate 2 are applied to said AND-gate 3, the output of said AND-gate 3 is connected to the reset terminal of said second counter 4.

Figure 2:
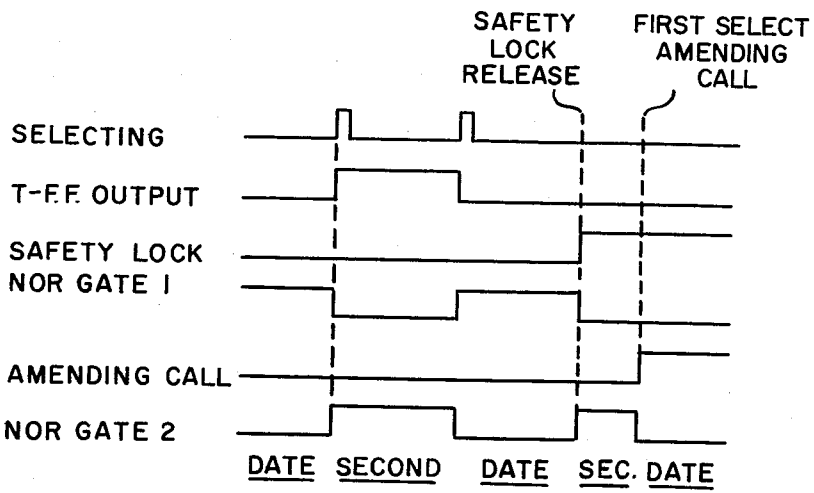

Referring now to the operation of the embodiment of the present invention:

As indicated in FIG. 2, if the display was the date display before said safety lock switch 8 is released, the signal from said safety lock switch 8 becomes from "0" to "1" when said safety lock switch 8 was released for the time amendment. The outputs "0" and "1" of said safety lock switch 8 and said T-type flip flop 12 are applied to said NOR gate 1. The output signal from NOR-gate 1 is "0" by two input signals "0" and "1" for NOR-gate 1. At this time, said amendment call circuit 10 is not operated for calling the amending figure whereby the output from said amendment call circuit 10 is "0".

The output "0" from said amendment call switching circuit 10 and the output "0" from NOR-gate 1 are applied to NOR-gate 2 as the input signal whereby the output "1" is generated. Said date/second display selecting circuit 13 displays the second display when the input signal is "1", and displays the date display when the input signal is "0". For example, the input signal for said date/second display selecting circuit 13 is "1" whereby the second display is displayed.

At this time, when the second reset circuit 11 is operated to ON, the signal "1" is applied to said AND-gate 3, the output signal "1" from NOR-gate 2 is applied to said AND-gate 3 whereby the output of AND-gate 3 becomes to "1", the second counter 4 is reset to the zero second.

Further when said amending figure calling switch circuit 10 is operated and is set to the first select position whereby the input signal for NOR-gate 2 from said amendment figure calling switch circuit 10 becomes from "0" to "1". The output signal "0" from NOR-gate 1 and the signal "1" of first select setting condition of said amendment figure calling switch circuit 10 are applied to two input terminals of NOR-gate 2 whereby the output signal from NOR-gate 2 becomes to "0". Said signal "0" is applied to said date/second display selecting circuit 13 as the input signal whereby the date display is displayed. At this time, said second reset switch 11 is operated to ON, the input signal for AND-gate 3 becomes to "1". Further the input signal for AND-gate 3 from NOR-gate 2 is "0", the output from AND-gate 3 is "0" whereby said second counter 4 is not reset to zero.

According to the present invention, the zero second reset operation is operated only during second display condition, and is not operated during date display condition. When said safety lock is released during the time amending condition, the second display is displayed. Further it is possible to avoide the carry by acknowledging the contents of second counter.

FIG. 3 shows the other detailed embodiment of the present invention. The same numerals in FIG. 1 are employed to the same portions in FIG. 3.

Referring now to the detailed embodiment in FIG. 1:

The signal of the date/second selecting switch 9 is applied to the flip-flop 12 (referring to FF as follows), the output of FF 12 and the signal of the safety lock switch 8 are applied to AND-gate 16 via the inverter 4, the output of AND-gate 16 is applied to OR-gate 17, the signal of said switch 8 and the output signal $\overline{Q}D$ of the ring counter 20 is applied to said OR-gate 17 via said AND-gate 18.

The output of said OR-gate 17 is applied to the gate input of the transmission gate 13 and generates the contents of the seconds counter 4 or the days counter 21. Said ring counter 20 is controlled by the output of said AND-gate 14 in which the signals of said switch 8 and the amendment call switch 10 are applied thereto, the output signal Qs of said ring counter 20 and the signal of the second reset switch 11 are applied to AND gate 15. The output of said AND-gate 15 is connected to the reset terminal of second counter 4.

Referring now to the operation of the circuit construction of FIG. 3.

Said switches 9, 8, 10 and 11 are maintained under the opened condition, said flip-flop 12 memrizes "1", said ring-counter 20 is reset. When the output $\overline{Q}D$ is "1", the signal "1" via said inverter 19 and the output "1" of said flip-flop 12 are applied to AND-gate 16, whereby the output of said AND-gate 16 becomes to "1". Further the output "1" of said AND-gate 16 is applied to said OR-gate 17, the gate signal of said transmission-gate 13 becomes to "1", said transmission-gate 13 is opened against said second counter 4 whereby the signal from said second counter 4 is generated and is displayed. When said switch 9 is closed, the contents of said flip-flop 12 is inverted and changed from "1" to "0". At this time, the outputs of AND-gates 16 and 18 are "0" whereby the output of OR-gate 17 becomes to "0", said transmission-gate 13 is opened to said date counter 21, namely said switch 9 is the date/second selecting switch for selecting the display of date and second of the display device.

When said switch 3 is closed, the signal of said switch 8 becomes to "1", the output "1" of $\overline{Q}D$ of said ring-counter 20 is applied to AND-gate 18 whereby the output of said AND-gate 18 becomes to "1", the output of said OR-gate 17 becomes to "1", said transmission gate 13 is opened against said second counter 4.

When said switch 3 is closed, the second display is displayed by the selecting operation of said switch 1 in spite of the display condition. When said switch 3 is opened, the input signals for said gates 16, 17 and 18 restored to the same condition before said switch is closed.

When said switch is closed, the signal "1" from said switch 8 is applied to one of input terminals of AND-gate 14, whereby the output signal of said AND-gate 14 becomes to the same value of the signal of said switch 10. Said flip-flop of said ring counter 20 memorizes the signal "1" whenver said switch 10 is pushed respectively. When the output Qs of said ring counter 20 is "1", the signal $\overline{Q}D$ becomes to "1" whereby the display is the second display condition. The signal "1" is applied to one of input terminals of AND gate 15, the input signals for AND-gate 15 become to "1" and "1" when said switch 11 is closed whereby the output becomes to "1". The output terminal of said AND gate 15 is connected to the reset terminal of said second counter 4 whereby it is possible to reset said second counter 4.

When the memorized contents of said ring counter 20 is shifted by said switch 10, the output QD is "1" namely $\overline{Q}D$ is 0 whereby AND-gate 8 is closed, the output signal of OR-gate 17 becomes to "0", said transmission-gate 13 is opened against the date counter 21.

FIG. 4 shows the display condition of selectively displaying the date and second respectively.

I claim:

1. An electronic timepiece, comprising: an oscillator circuit for generating a repetitive time standard signal; a second counter, a minute counter, an hour counter, and a date counter connected in cascade in the named order and connected to count the time standard signal for developing respective counts representative of seconds, minutes, hours and date; a display reponsive to the counts developed by respective ones of said counters for displaying time represented by said counts; date-seconds selecting means responsive to a control signal for selectively applying a respective one of the counts developed by said second counter and said date counter under control of said control signal; and control means for applying the control signal to said date-seconds selecting means, said control means comprising a safety lock switch, a date-second selecting switch, an amendment call switch and a second reset switch each operable between an open condition and a closed condition for applying a signal, a first flip-flop connected to receive a signal applied to said date-second selecting switch and developing an output signal according to the setting of said date-second selecting switch; a first NOR-gate connected to receive an output of said flip-flop and a signal applied by said safety lock switch for developing an output signal determined by the setting of said safety lock switch and the output of said flip-flop; a second NOR-gate connected to receive the output of said first NOR-gate and a signal applied under control of said amendment call switch for developing as an output signal said control signal and for applying the same to said date-seconds selecting means; and an AND gate connected for receiving said control signal and a signal applied under control of said second reset switch and connected for applying an output thereof to reset said seconds counter when said control signal and the signal applied by said second reset switch are simultaneously developed.

* * * * *